US009456690B2

(12) United States Patent
Feuerstein

(10) Patent No.: US 9,456,690 B2
(45) Date of Patent: Oct. 4, 2016

(54) DOUBLE-WALLED DRAWER FRAME WITH AN INNER WALL AND AN OUTER WALL

(71) Applicant: Julius Blum GmbH, Hoechst (AT)

(72) Inventor: Markus Feuerstein, Hoechst (AT)

(73) Assignee: JULIUS BLUM GMBH, Hoechst (AT)

( * ) Notice: Subject to any disclaimer, the term of this patent is extended or adjusted under 35 U.S.C. 154(b) by 48 days.

(21) Appl. No.: 14/296,910

(22) Filed: Jun. 5, 2014

(65) Prior Publication Data

US 2014/0285080 A1 Sep. 25, 2014

Related U.S. Application Data

(63) Continuation of application No. PCT/AT2012/000278, filed on Nov. 2, 2012.

(30) Foreign Application Priority Data

Dec. 22, 2011 (AT) ..... A 1869/2011

(51) Int. Cl.
*A47B 88/00* (2006.01)

(52) U.S. Cl.
CPC .... *A47B 88/0014* (2013.01); *A47B 2088/0037* (2013.01); *A47B 2210/02* (2013.01)

(58) Field of Classification Search
CPC ..... A47B 88/0014; A47B 88/00; A47B 88/0003; A47B 2210/02; A47B 88/0422; A47B 2088/0037
USPC ..... 312/348.1, 330.1, 348.2, 263, 334.6, 312/334.7, 111, 265.5
See application file for complete search history.

(56) References Cited

U.S. PATENT DOCUMENTS 3,892,451 A * 7/1975 Bruins ..... A47B 88/20 108/61
4,911,509 A * 3/1990 Rock ..... A47B 88/0014 312/348.1
5,292,190 A * 3/1994 Lautenschlager .. A47B 88/0014 312/330.1

(Continued)

FOREIGN PATENT DOCUMENTS

AT 005 171 4/2002
CN 101204274 6/2008

(Continued)

OTHER PUBLICATIONS

English translation of WO 2006125630, Nov. 30, 2006.*

(Continued)

*Primary Examiner* — Daniel J Troy
*Assistant Examiner* — Hiwot Tefera
(74) *Attorney, Agent, or Firm* — Wenderoth, Lind & Ponack, L.L.P.

(57) ABSTRACT

A double-walled drawer frame includes an inner wall and an outer wall that can be bonded to each other, preferably with adhesive. The inner wall has an inner wall bonding section, and the outer wall has an outer wall bonding section. The inner wall bonding section and the outer wall bonding section are arranged in the interior of the double-walled drawer frame in the assembly position, and can be bonded to each other for the bonding of the inner wall with the outer wall. The inner wall can be stably fixed in its position relative to the outer wall by a mechanical holding device that can be bonded to the inner wall bonding section and the outer wall bonding section.

15 Claims, 6 Drawing Sheets

(56) References Cited

U.S. PATENT DOCUMENTS

| | | | | | |
|---|---|---|---|---|---|
| 5,452,952 | A * | 9/1995 | Grabher | A47B 88/0014 | 312/348.1 |
| 5,478,146 | A | 12/1995 | Grabher | | |
| 5,556,183 | A * | 9/1996 | Brustle | A47B 88/0422 | 312/330.1 |
| 5,971,516 | A * | 10/1999 | Huber | A47B 88/0014 | 312/265.5 |
| 5,992,958 | A * | 11/1999 | Scheible | A47B 88/0014 | 312/330.1 |
| 6,095,627 | A | 8/2000 | Sutterlutti | | |
| 6,474,761 | B1 * | 11/2002 | Muterthies | A47B 88/0422 | 312/330.1 |
| 8,038,234 | B2 * | 10/2011 | Weber | A47B 88/0055 | 312/348.1 |
| 2006/0005502 | A1 | 1/2006 | Bodingbauer | | |
| 2006/0049730 | A1 * | 3/2006 | Sutterlutti | A47B 88/00 | 312/330.1 |
| 2008/0315740 | A1 | 12/2008 | Lam et al. | | |

FOREIGN PATENT DOCUMENTS

| | | | |
|---|---|---|---|
| CN | 201282846 | | 8/2009 |
| DE | 91 02 828 | | 5/1991 |
| DE | 202 03 551 | | 5/2002 |
| DE | 20203551 | * | 5/2002 |
| DE | 20 2005 008 286 | | 10/2006 |
| DE | 10 2008 024 673 | | 11/2009 |
| EP | 0 503 234 | | 9/1992 |
| EP | 0 966 903 | | 12/1999 |
| EP | 1 614 369 | | 1/2006 |
| WO | 2006/125630 | | 11/2006 |
| WO | 2009/141046 | | 11/2009 |

OTHER PUBLICATIONS

Chinese Search Report (SR) issued Jul. 20, 2015 in Chinese Patent Application No. 201280067698.8.

International Search Report (ISR) issued Mar. 13, 2013 in International (PCT) Application No. PCT/AT2012/000278.

Austrian Patent Office Search Report (ASR) issued Aug. 6, 2012 in Austrian Patent Application No. A 1869/2011.

* cited by examiner

DOUBLE-WALLED DRAWER FRAME WITH AN INNER WALL AND AN OUTER WALL

BACKGROUND OF THE INVENTION

The invention concerns a double-walled drawer frame member having an inner wall and an outer wall which can be connected together, preferably with adhesive. The inner wall has an inner wall connecting portion and the outer wall has an outer wall connecting portion. In the assembled position, the inner wall connecting portion and the outer wall connecting portion are arranged in the interior of the double-walled drawer frame member and can be connected together for connecting the inner wall to the outer wall.

Double-walled drawer frame members are frequently produced in an automated production process. In that case, the inner wall and the outer wall of the double-walled drawer frame member are suitably moved in position by a joining device and connected together with a suitable connecting procedure, for example by welding, adhesive, riveting, screwing or clinching. Particularly when the two walls are glued together with adhesive, hitherto the double-walled drawer frame member has to remain in the joining device until the adhesive has hardened and thus the inner wall is fixedly joined to the outer wall. It is only thereafter that the joining device is brought out of engagement with the inner wall, and the outer wall and the double-walled drawer frame member can pass through the further production steps.

SUMMARY OF THE INVENTION

The object of the invention is to provide a double-walled drawer frame member which is improved over the state of the art, and an improved process for producing such a double-walled drawer frame member. In particular, the invention seeks to provide that the production process of a double-walled drawer frame member is improved or speeded up.

According to the invention, a mechanical holding device can be connected to the inner wall connecting portion and the outer wall connecting portion by which the inner wall can be fixed in positionally stable relationship relative to the outer wall.

Insofar as the inner wall can be fixed in a positionally stable relationship relative to the outer wall at least at times by a mechanical holding device, the joining device can already be brought out of engagement with the inner wall and the outer wall at an early time. Thus, the further production steps for producing a double-walled drawer frame member in an automated production process can already be carried out earlier than hitherto. Particularly, when the inner wall is glued to the outer wall, the residence time of the double-walled drawer frame member at the adhesive station can be reduced to a few seconds although the adhesive hardening time is possibly several minutes. In that way, the cycle time of the production process can be reduced and thus the amount of double-walled drawer frame members produced per unit of time can be increased.

In a preferred embodiment, the inner wall connecting portion and the outer wall connecting portion are arranged in an upper end region of the double-walled drawer frame member. Preferably, the holding device is arranged substantially only in the region of the inner wall connecting portion and the outer wall connecting portion. In that way, the material expenditure for the mechanical holding device can be restricted to a minimum.

In regard to the holding device which, for example, can be in the form of a holding clip, a first contact surface of the holding device can be connected to the inner wall connecting portion and a second contact surface of the holding device can be connected to the outer wall connecting portion. Preferably, the inner wall connecting portion and the outer wall connecting portion can be clamped or gripped between the first contact surface and the second contact surface.

In that respect, it has proven to be particularly advantageous if in the assembled position of the holding device, the first contact surface bears resiliently against the inner wall connecting portion and/or the second contact surface bears resiliently against the outer wall connecting portion.

A desirable development of the invention provides that the first contact surface is formed from a plurality of first individual abutments, and/or the second contact surface is formed from a plurality of second individual abutments.

It is particularly advantageous if the holding device for insertion into the double-walled drawer frame member has a preferably substantially slot-shaped opening. The first contact surface is arranged at a first wall of the opening, and the second contact surface is arranged at a second wall of the opening.

Preferably in that respect to facilitate insertion of the holding device into the double-walled drawer frame member, the first wall of the opening and/or the second wall of the opening has or have an inclined run-on surface.

A particularly advantageous embodiment of the invention is one in which the holding device has a first limb and a second limb which projects preferably substantially perpendicularly from the first limb, and the opening is provided in the first limb. In that way, the holding device can be pushed into the double-walled drawer frame member until the second limb comes to bear against an end face of the double-walled drawer frame member.

In a further variant, the holding device is of a substantially ring-shaped configuration.

The holding device can preferably be of a one-piece configuration, and can also at least partially and preferably completely comprise a plastic or a metal, preferably spring steel. A drawer can have at least one and preferably two double-walled drawer frame member of the present invention.

In a process according to the invention for the production of a double-walled drawer frame member comprising an inner wall, an outer wall and a mechanical holding device, an inner wall connecting portion of the inner wall is connected to an outer wall connecting portion of the outer wall. The inner wall is connected, preferably glued, to the outer wall at least in the region of the inner wall connecting portion and the outer wall connecting portion. The mechanical holding device is mounted in the interior of the double-walled drawer frame member to the inner wall connecting portion and to the outer wall connecting portion, and the mechanical holding device fixes the outer wall in positionally stable relationship relative to the inner wall.

Preferably, the inner wall and the outer wall are glued together at least in the region of the inner wall connecting portion and the outer wall connecting portion.

In a preferred embodiment of the invention, to glue the inner wall to the outer wall, the inner wall is positioned relative to the outer wall by a preferably automated joining device, and the holding device for fixing in a positionally stable relationship is mounted to the inner wall connecting portion and to the outer wall connecting portion. The joining device is brought out of engagement with the inner wall and the outer wall before the adhesive has completely hardened.

In a particularly preferred embodiment, the holding device is inserted into the double-walled drawer frame member by an end of the double-walled drawer frame member. As a further consequence, the holding device can remain in the interior of the double-walled drawer frame member or can be removed again and re-used.

BRIEF DESCRIPTION OF THE DRAWINGS

Further details and advantages of the present invention will be described more fully hereinafter by the specific description with reference to the embodiments by way of example illustrated in the drawings, in which.

DETAILED DESCRIPTION OF THE INVENTION

Figure 1:
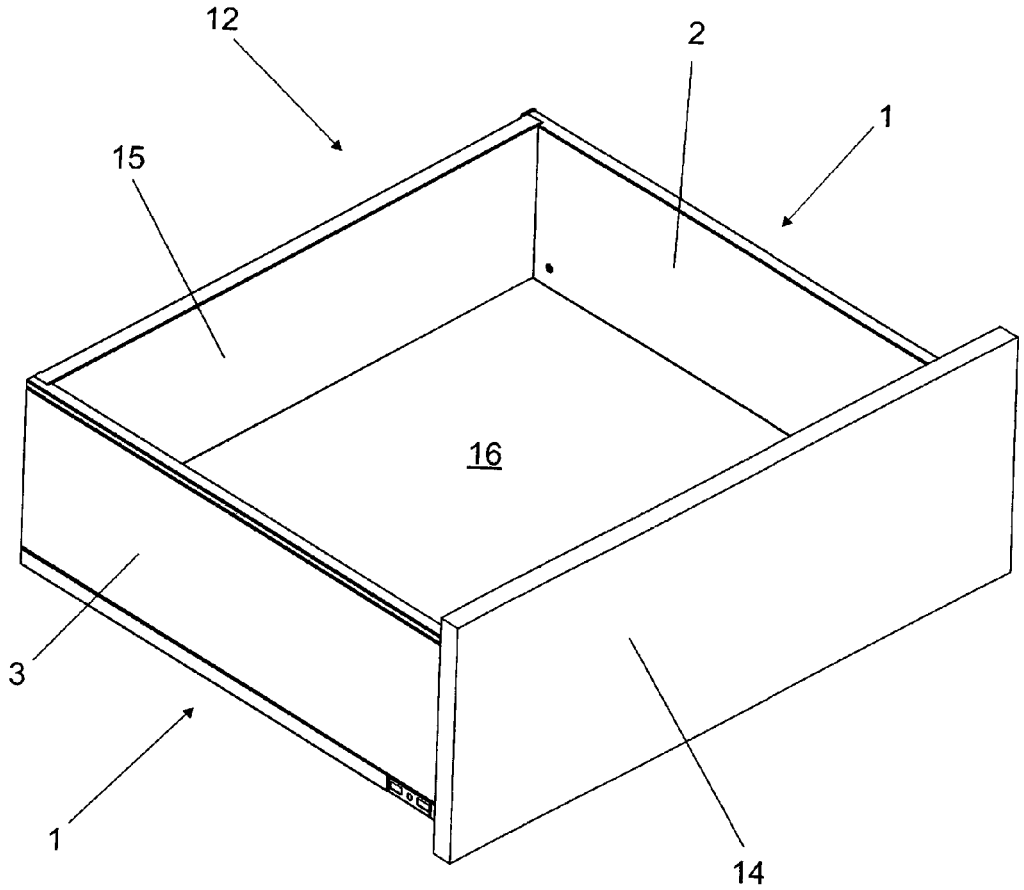
FIG. 1 shows a drawer with two proposed double-walled drawer frame members.

FIG. 1 shows a drawer 12 with two double-walled drawer frame members 1 which each include an inner wall 2 and an outer wall 3. In addition, the drawer 12 includes a drawer bottom 16 as well as a rear wall 15 and a front panel 14.

Figure 2A:
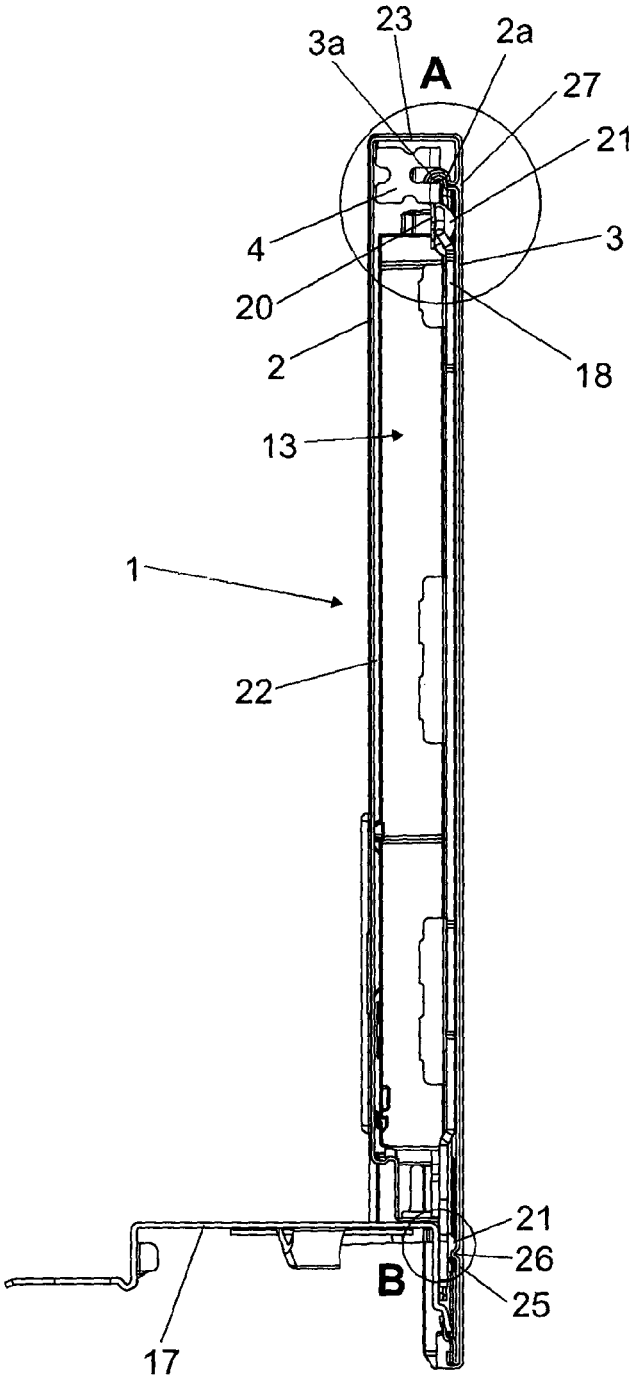
FIG. 2*a* is a front view of a proposed holding device inserted into a double-walled drawer frame member.
Figure 2B:
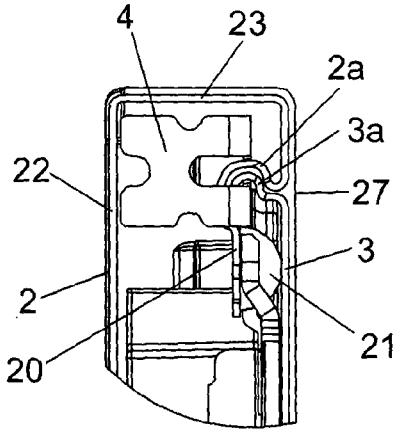
FIGS. 2*b* and 2*c* are detail views of the double-walled drawer frame member of FIG. 2*a*.
Figure 2C:
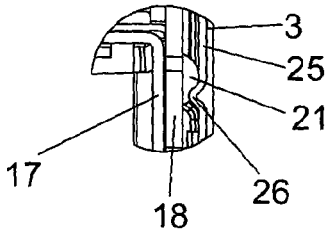

FIG. 2*a* shows a front view of a proposed double-walled drawer frame member 1, FIG. 2*b* shows the region A marked with a circle in FIG. 2*a* on an enlarged scale and FIG. 2*c* shows the detail region B with a circle in FIG. 2*a* on an enlarged scale. The double-walled drawer frame member 1 includes an inner wall 2 and an outer wall 3.

In this example, the inner wall 2 has a wall portion 22 adjoined in the upper end region of the wall portion 22 by a cover 23 which is substantially U-shaped in cross-section. In this arrangement, the cover 23 is formed by a portion bent over along the upper longitudinal edge of the wall portion 22 and at the same time represents the upper edge of the double-walled drawer frame member 1. Adjoining the cover 23 is an inner wall connecting portion 2*a* which has a substantially S-shaped configuration and thereby serves as a pivot mounting for an outer wall connecting portion 3*a*, corresponding to that configuration, of the outer wall 3. A perpendicular profile portion forms an end portion 20 of the inner wall 2 and adjoins the S-shaped inner wall connecting portion 2*a*.

The outer wall 3 has an outer wall connecting portion 3*a* which is bent in a hook shape along the upper longitudinal edge and corresponds to the configuration of the inner wall connecting portion 2*a*. The outer wall 3 can be hangingly engaged by the outer wall connecting portion 3*a* into the inner wall connecting portion 2*a*, which is in the form of a pivot mounting, of the inner wall 2.

In this example, to connect the inner wall 2 to the outer wall 3, an adhesive strip 21 (see FIG. 3) extending in the direction of the longitudinal extent of the inner wall 2 is arranged at the end portion 20 of the inner wall 2. The adhesive used in that case can be, for example, a two-component adhesive which is applied to the end portion 20 of the inner wall 2 by an automated process before the outer wall 3 is hangingly engaged into the inner wall connecting portion 2*a*. To connect the inner wall 2 to the outer wall 3 in a lower end region of the double-walled drawer frame member 1, a further adhesive strip 21 is also arranged on an inner wall end portion 24, which adhesive strip can also be applied by an automated process (see FIG. 3).

In this example, the inner wall end portion 24 is connected (for example welded, riveted, clinched) to a per se known container rail 17 which is to be further connected in known manner to a drawer bottom 16.

After the outer wall 3 is brought into engagement with its hook-shaped outer wall connecting portion 3*a* overlapping the inner wall connecting portion 2*a* which is of a substantially S-shaped configuration, the outer wall 3 can be pivoted in the direction of the inner wall 2 until the outer wall 3 is arranged substantially parallel to the inner wall 2 and is pressed against the adhesive strips 21. To be able to press the outer wall 3 better with the adhesive strip 21 on the inner wall end portion 24, the outer wall end portion 25 has a nose-shaped curved indentation portion 26 which is pressed into the adhesive strip 21 and thus achieves a better bonding action.

In order to fix the inner wall 2 in a positionally stable relationship to the outer wall 3 during hardening of the adhesive of the adhesive strips 21, a mechanical holding device 4—introduced through the end 13 of the double-walled drawer frame member 1—can be connected in the form of a holding clip to the inner wall connecting portion 2*a* and the outer wall connecting portion 3*a* to thereby fix the adhesive joint at least until the adhesive is completely hardened.

Figure 3:
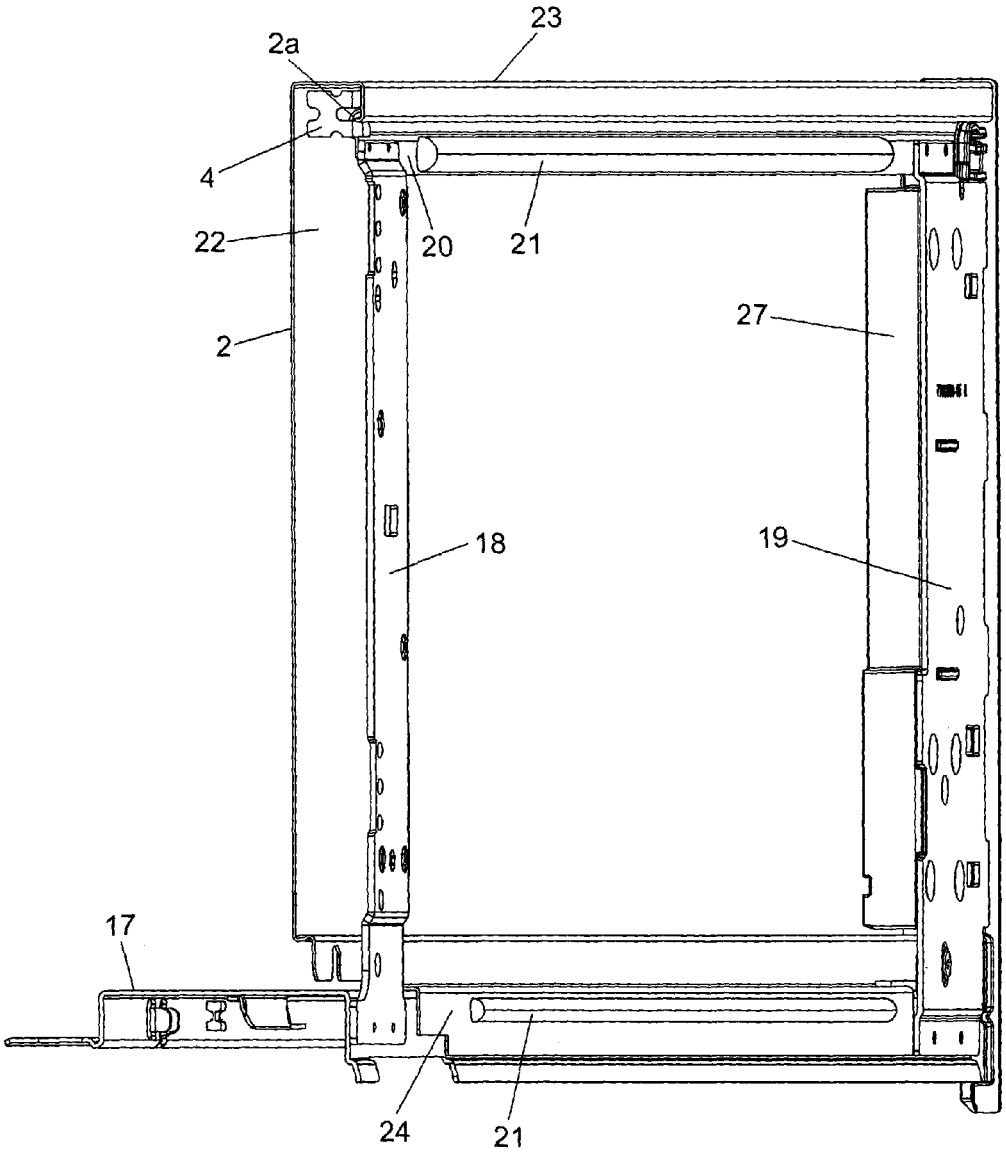
FIG. 3 is a perspective view of the double-walled drawer frame member of FIG. 2*a*, FIGS. 4*a* through 4*d* are various views of a proposed holding device.

FIG. 3 shows a perspective view of the double-walled drawer frame member 1 as shown in FIG. 2*a*, the outer wall 3 having been removed for the sake of clarity of the drawing. In this variant, the connection of the inner wall end portion 24 to the container rail 17 does not extend along the entire longitudinal extent of the container rail 17 but the inner wall 2, in the front and rear end regions of the container rail 17, has corresponding openings. In that way, a front fitment 18 and a rear fitment 19 can be connected directly to the container rail 17 in those regions, for example by welding or riveting. A rear wall holder 27 can be subsequently mounted to the rear fitment 19, the rear wall holder 27 serving to fix a rear wall 15 of a drawer 12, while a front fitting assembly (not shown here) can be mounted to the front fitment 18, the front fitting assembly subsequently serving for fixing and/or heightwise and lateral adjustment of a front panel 14 of a drawer 12 (see FIG. 1). In their upper end regions, the front fitment 18 and the rear fitment 19 are respectively connected to the substantially vertically projecting end portion 20 of the inner wall 2, for example by welding. In this example, an adhesive strip 21 is arranged between the front fitment 18 and the rear fitment 19 for glueing the outer wall 3 to the inner wall 2, at the vertical end portion 20 of the inner wall 2, which adjoins the inner wall connecting portion 2*a*. An adhesive strip 21 is also provided at the lower inner wall end portion 24 of the inner wall 2, that is connected to the container rail 17, for glueing the outer wall 3 to the inner wall 2.

Figure 4A:
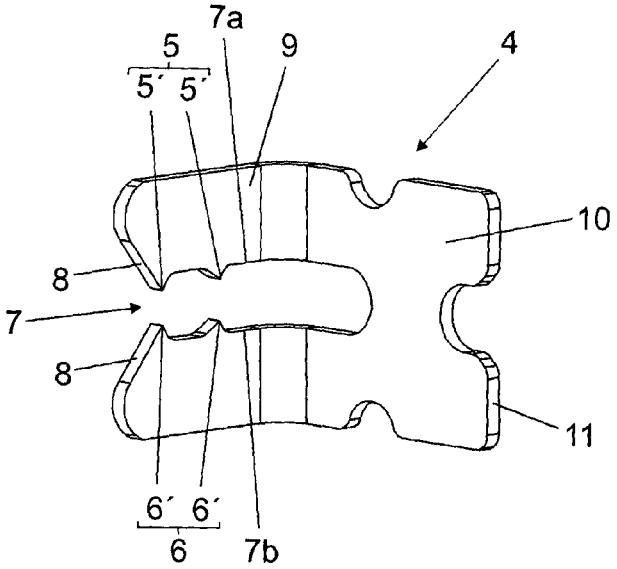
Figure 4B:
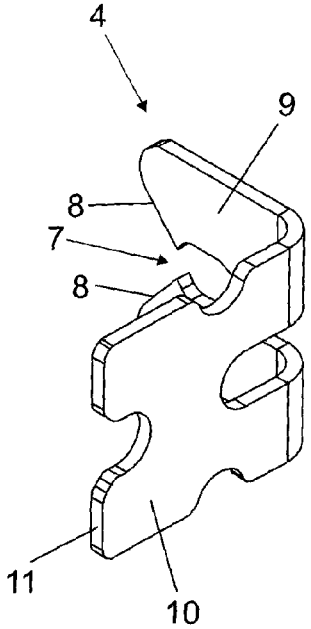
Figure 4C:
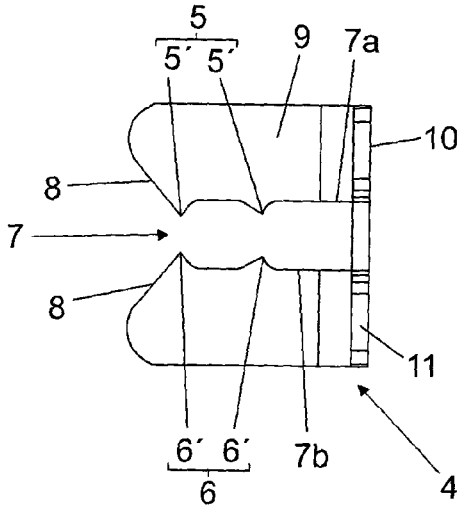
Figure 4D:
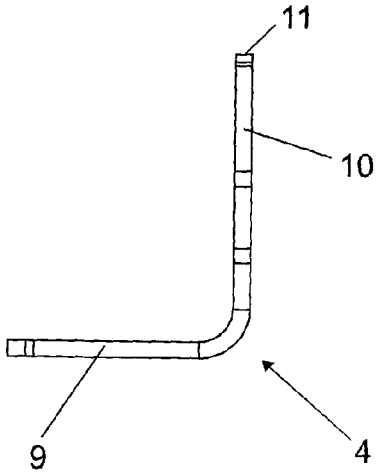

FIGS. 4*a* and 4*b* show two perspective views of a proposed holding device 4, FIG. 4*c* shows a side view and FIG. 4*d* shows a view from below of the holding device 4 of FIG. 4*a*. The mechanical holding device 4 shown here has a first limb 9 and a second limb 10 projecting substantially perpendicularly therefrom. In addition, the first limb 9 has a substantially slot-shaped opening 7 which in this example extends into the second limb 10. Arranged at a first wall 7*a* of the opening 7 are two first individual abutments 5' which jointly form a first contact surface 5. Likewise, the second wall 7*b* of the opening 7 has two second individual abutments 6' which jointly form a second contact surface 6. To facilitate insertion of the holding device 4 into a connecting region of a double-walled drawer frame member 1 the first wall 7*a* and the second wall 7*b* respectively have an inclined run-on surface 8.

Figure 5A:
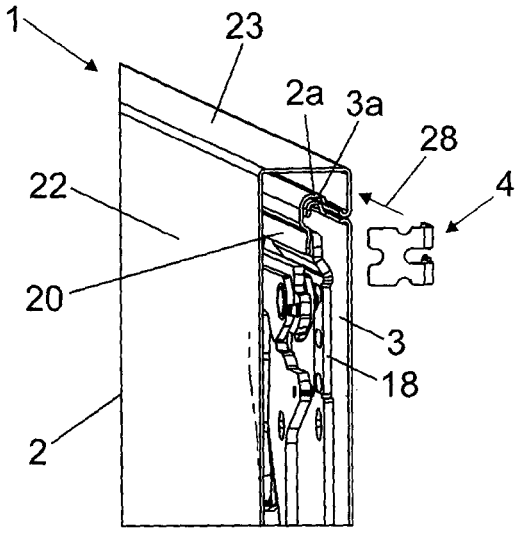
FIG. 5*a* shows the procedure for inserting a holding device into a double-walled drawer frame member.

FIG. 5*a* shows a double-walled drawer frame member 1, as shown in FIG. 2*a*, into which is fitted a holding device 4 as shown in FIG. 4*a*. Upon insertion of the mechanical holding device 4 into the connecting region (overlapping portion) between the inner wall 2 and the outer wall 3, which in this example is in the form of a substantially S-shaped pivot mounting as the inner wall connecting portion 2*a* and the outer wall connecting portion 3*a* corresponding thereto in its configuration, the mechanical holding device 4 is pushed in, in the direction of the illustrated arrow 28 (i.e., pushed in a longitudinal direction of the drawer frame member 1 from an end 13—front or rear—of the drawer frame member 1 in a longitudinal direction of the drawer frame member). In this case, the inclined run-on surfaces 8 of the holding device 4 facilitate insertion of that holding device 4 which is in the form of a holding clip. The holding device 4 is now inserted until the second limb 10 thereof bears against the end 13 of the double-walled drawer frame member 1. The end 11 of the second limb 10 of the holding device 4 is disposed in this example in the inserted position of the holding device 4 against the inner wall 2 and its substantially vertically extending wall portion 22.

Figure 5B:
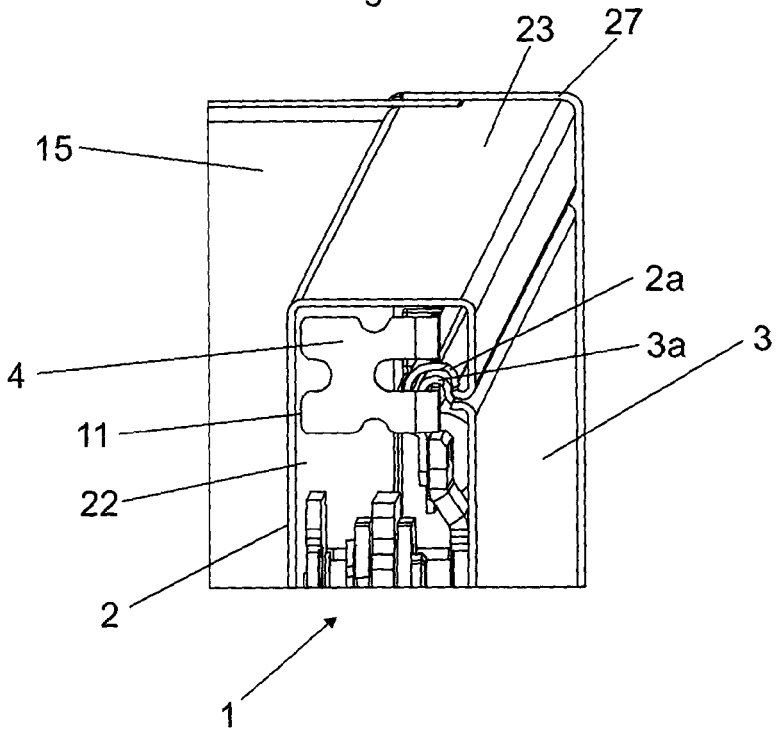
FIG. 5*b* shows a holding device inserted into the double-walled drawer frame member of FIG. 5*a*, FIGS. 6*a* through 6*c* are various views of a further proposed holding device.

In the assembled position of the mechanical holding device 4 as shown in FIG. 5*b*, the first contact surface 5 bears against the inner wall connecting portion 2*a* and the second contact surface 6 bears against the outer wall connecting portion 3*a* so that the inner wall connecting portion 2*a* and the outer wall connecting portion 3*a* are clamped between the first contact surface 5 and the second contact surface 6. Thus, the inner wall 2 is fixed in a positionally stable relationship relative to the outer wall 3. An adhesive previously introduced between the inner wall 2 and the outer wall 3—for example, in the form of adhesive strip 21—can now harden without the double-walled drawer frame member 1 as an entirety having to remain at that point in a production process until the adhesive is completely hardened.

Figure 6A:
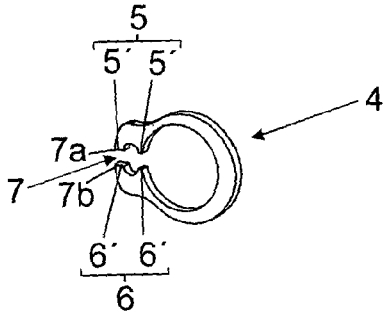
Figure 6B:
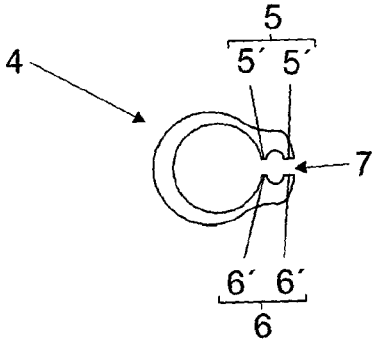

FIG. 6*a* shows a perspective view of a further proposed mechanical holding device 4, FIG. 6*b* shows a side view and FIG. 6*d* shows a view from below of the holding device 4. In this example, the holding device 4 has a substantially ring-shaped configuration and has an opening 7 whose first wall 7*a* has two first individual abutments 5' and whose second wall 7*b* has two second individual abutments 6'. The two first individual abutments 5' jointly form a first contact surface 5, and the two second individual abutments 6' jointly form a second contact surface 6.

Figure 6C:
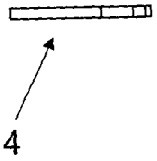
Figure 7:
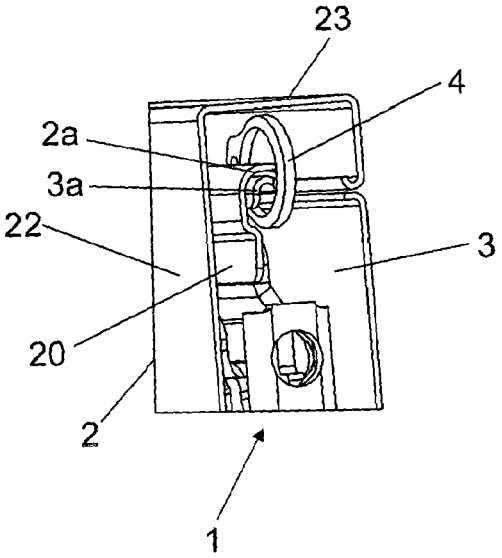
FIG. 7 shows a holding device as shown in FIG. 6*a* inserted into a double-walled drawer frame member.

FIG. 7 shows an upper end region of a double-walled drawer frame member 1, in the connecting region of which a mechanical holding device 4 as shown in FIGS. 6*a* through 6*c* was inserted between the inner wall 2 and the outer wall 3 for providing a positionally stable fixing. In this case, the inner wall connecting portion 2*a* and the outer wall connecting portion 3*a* are clamped between the first contact surface 5 and the second contact surface 6 of the holding device 4 so that an adhesive introduced in that region between the inner wall 2 and the outer wall 3 can harden without the double-walled drawer frame member 1 having to remain at that point in a production process.

For all illustrated embodiments of the double-walled drawer frame member 1, the inner wall 2 and the outer wall 3 can, for example, comprise a steel or aluminum sheet, and the above-described special and multi-functional configurations of the inner wall 2 and the outer wall 3 can in that case be implemented by a sheet bending process.

The invention claimed is:

1. A double-walled drawer frame member comprising:

an inner wall extending substantially an entire height of said drawer frame member and having an inner wall connecting portion;

an outer wall adhesively connected to said inner wall and having an outer wall connecting portion, said inner wall connecting portion and said outer wall connecting portion being arranged within an interior of said drawer frame member and being connected together so as to connect said inner wall to said outer wall; and a mechanical holding device connected to said inner wall connecting portion and said outer wall connecting portion to fix said inner wall in a positionally stable relationship relative to said outer wall;

wherein said inner wall, said outer wall, and said mechanical holding device are configured such that said mechanical holding device is inserted into said interior of said drawer frame member in a longitudinal direction of said drawer frame member;

wherein said mechanical holding device has a first contact surface connected to said inner wall connecting portion and a second contact surface connected to said outer wall connecting portion so as to clamp said inner wall connecting portion and said outer wall connecting portion between said first contact surface and said second contact surface;

wherein said mechanical holding device has a slot-shaped opening, said first contact surface being arranged on a first wall of said opening and said second contact surface being arranged on a second wall of said opening; and wherein said mechanical holding device has a first limb and a second limb projecting substantially perpendicularly from said first limb, said opening being located in said first limb.

2. The double-walled drawer frame member as set forth in claim 1, wherein said mechanical holding device is inserted into a front end of said interior of said double-walled drawer frame member.

3. The double-walled drawer frame member as set forth in claim 1, wherein said inner wall and said outer wall are glued together at least in a region of said inner wall connecting portion and said outer wall connecting portion.

4. The double-walled drawer frame member as set forth in claim 1, wherein said inner wall connecting portion and said outer wall connecting portion are arranged in an upper region of said drawer frame member, said holding device being arranged substantially only in a region of said inner wall connecting portion and said outer wall connecting portion.

5. The double-walled drawer frame member as set forth in claim 1, wherein said mechanical holding device is formed as a holding clip.

6. The double-walled drawer frame member as set forth in claim 1, wherein at least one of: (i) said first contact surface bears resiliently against said inner wall connecting portion; and (ii) said second contact surface bears resiliently against said outer wall connecting portion.

7. The double-walled drawer frame member as set forth in claim 1, wherein at least one of: (i) said first contact surface is formed of a plurality of first individual abutments; and (ii) said second contact surface is formed of a plurality of second individual abutments.

8. The double-walled drawer frame member as set forth in claim 1, wherein at least one of said first wall of said opening and said second wall of said opening has an inclined run-on surface.

9. The double-walled drawer frame member as set forth in claim 1, wherein said mechanical holding device is formed of spring steel.

10. The double-walled drawer frame member as set forth in claim 1, wherein said inner wall connecting portion and said outer wall connecting portion overlap each other within an interior of said drawer frame member, and an overlapping portion of said inner wall connecting portion and said outer wall connecting portion being held within said slot-shaped opening of said mechanical holding device.

11. A drawer comprising:

a rear wall;

a front wall; and at least one double-walled drawer frame member as set forth in claim 1 connecting said rear wall and said front wall.

12. A double walled-drawer frame member comprising:

an inner wall extending substantially an entire height of said drawer frame member and having an inner wall connecting portion;

an outer wall adhesively connected to said inner wall and having an outer wall connecting portion, said inner wall connecting portion and said outer wall connecting portion being arranged within an interior of said drawer frame member and being connected together so as to connect said inner wall to said outer wall; and a mechanical holding device connected to said inner wall connecting portion and said outer wall connecting portion to fix said inner wall in a positionally stable relationship relative to said outer wall;

wherein said inner wall, said outer wall, and said mechanical holding device are configured such that said mechanical holding device is inserted into said interior of said drawer frame member in a longitudinal direction of said drawer frame member;

wherein said mechanical holding device has a slot-shaped opening, said inner wall connecting portion and said outer wall connecting portion overlapping each other within an interior of said drawer frame member, and an overlapping portion of said inner wall connecting portion and said outer wall connecting portion being held within said slot-shaped opening of said mechanical holding device; and wherein said mechanical holding device has a first limb with said slot-shaped opening and a second limb extending perpendicular from said first limb, said first limb of said mechanical holding device being within said interior of said drawer frame member and said second limb of said mechanical holding device bearing against an end of said drawer frame member.

13. A process of producing a double-walled drawer frame member, said process comprising:

providing an inner wall having an inner wall connecting portion and extending along an entire height of the drawer frame member, an outer wall having an outer wall connecting portion, and a mechanical holding device;

connecting the inner wall connecting portion of the inner wall to the outer wall connecting portion of the outer wall, said connecting comprising gluing the inner wall connecting portion and the outer wall connecting portion; and inserting the mechanical holding device into an interior of the drawer frame member in a longitudinal direction of the drawer frame member so as to engage the inner wall connecting portion and the outer wall connecting portion, whereby the mechanical holding device fixes the outer wall in a positionally stable relationship relative to the inner wall;

wherein said gluing the inner wall connecting portion to the outer wall connecting portion comprises positioning the inner wall relative to the outer wall by an automated joining device and gluing with adhesive; and wherein said inserting of the mechanical holding device into the interior of the drawer frame member comprises mounting the holding device to the inner wall connecting portion and to the outer wall connecting portion, the joining device being disengaged from the inner wall and the outer wall before the adhesive has completely hardened.

14. The process as set forth in claim 13, wherein said inserting of the mechanical holding device comprises inserting the mechanical holding device through an end of the drawer frame member.

15. The process as set forth in claim 13, wherein the mechanical holding device has a first limb with a slot-shaped opening and a second limb extending perpendicular from said first limb, said inserting of the mechanical holding device comprising inserting the mechanical holding device such that the first limb of the mechanical holding device is within the interior of the drawer frame member and the second limb of the mechanical holding device bears against an end of the drawer frame member.

* * * * *